United States Patent [19]

Pellegri

[11] 4,263,107

[45] Apr. 21, 1981

[54] ELECTROLYTIC APPARATUS AND PROCESS

[75] Inventor: Alberto Pellegri, Luino, Italy

[73] Assignee: Oronzio de Nora Impianti Elettrochimici S.p.A., Milan, Italy

[21] Appl. No.: 140,137

[22] Filed: Apr. 14, 1980

Related U.S. Application Data

[63] Continuation-in-part of Ser. No. 94,962, Nov. 16, 1979, abandoned.

[30] Foreign Application Priority Data

May 3, 1979 [IT] Italy ..... 22318 A/79

[51] Int. Cl.[3] ..... C25B 1/40; C25B 9/00; C25B 11/03

[52] U.S. Cl. ..... 204/99; 204/219; 204/284

[58] Field of Search ..... 204/23, 99, 237, 261, 204/270, 277, 221, 219, 284

[56] References Cited

U.S. PATENT DOCUMENTS

| | | | |
|---|---|---|---|
| 3,409,533 | 11/1968 | Murayama | 204/219 |
| 3,507,771 | 4/1970 | Dönges | 204/284 |
| 3,535,223 | 10/1970 | Baecklund | 204/284 |
| 3,647,672 | 3/1972 | Mehandjiev | 204/278 |
| 3,725,223 | 4/1973 | deNora | 204/219 |
| 3,795,603 | 3/1974 | Glos | 204/219 |
| 3,839,179 | 10/1974 | Koziol | 204/219 |
| 3,930,151 | 12/1975 | Shibata | 204/270 |
| 3,930,981 | 1/1976 | deNora | 204/270 |
| 4,035,279 | 7/1977 | Lohrberg | 204/270 |

FOREIGN PATENT DOCUMENTS

| | | |
|---|---|---|
| 1068992 | 5/1967 | United Kingdom . |
| 1206762 | 9/1970 | United Kingdom . |
| 1333289 | 10/1973 | United Kingdom . |

*Primary Examiner*—T. M. Tufariello
*Attorney, Agent, or Firm*—Hammond & Littell, Weissenberger and Muserlian

[57] ABSTRACT

Mass transfer to the surface of a substantially horizontal, foraminous gas-evolving electrode, suspended in the electrolyte pool over a co-operating electrode, is improved by inducing a vigorous multiple recirculation motion of the electrolyte to and from the interelectrodic gap through the openings in the foraminous electrode exploiting the gas lift of evolved gas bubbles by means of a multiplicity of baffles, alternatively slanting one way and the opposite with respect to the vertical axis, and defining, with their lower edges, an alternating series of large and small areas over the foraminous electrode surface; electrodes and cells incorporating the hydrodynamic means to effect recirculation are also disclosed.

11 Claims, 4 Drawing Figures

ELECTROLYTIC APPARATUS AND PROCESS

PRIOR APPLICATION

This application is a continuation-in-part of my copending commonly assigned U.S. Patent application Ser. No. 94,962 filed Nov. 16, 1979, now abandoned.

STATE OF THE ART

Mercury cathode cells for the electrolysis of aqueous alkali metal halide solutions, especially, sodium chloride, are well known. In the last 10 to 20 years, the previously used consumable graphite anodes have been replaced with dimensionally stable metal electrodes whereby extremely high current densities may be used. The dimensionally stable electrode are normally a foraminous or rod structure made of a valve metal such as titanium with an exterior coating of an electrically conductive, electrocatalytic material such as platinum group metals or oxides thereof optionally containing other metal oxides as described in U.S. Pat. No. 3,711,385 and U.S. Pat. No. 3,632,498, for instance. Current densities of about 11 to 14 $KA/m^2$ of projected anode surface may be used with a metal anode-mercury cathode gap of 2 to 3 millimeters.

Under these conditions, the mass transfer to the anode surface becomes the determining factor and a sufficient chloride ion supply to the anode must be maintained to make up for brine depletion in the narrow interelectrodic gap. A sufficient chloride ion supply is possible only through a diffusion mechanism due to a concentration gradient between the brine in the interelectrodic gap and the bulk of the brine in the cell submerging the anodes or by a forced hydrodynamic flow transfering concentrated brine from the bulk inside the cell into the interelectrode gap.

Gas bubbles produced at the anodes are effective in generating a certain turbulence and introducing convective motions within the electrolyte and the foraminous metal anodes are also from this standpoint advantageous over the obsolete graphite anodes. The high current densities adopted have, nevertheless, posed the problem again in all its importance with consequent limits to the use of wide-mesh anodic structures, which although per se favorable to said chloride ions supply, entail intolerable ohmic drops within the titanium structure.

The effects of poor chloride ion supply to the anode due to a too severe depletion of brine in the interelectrodic gap are (a) an increase of the oxygen level in the anode-evolved chlorine because of competing water electrolysis, and above all, (b) a dramatic shortening of the anode's life since the catalytic coating becomes passivated and is leached from the titanium base. To overcome such disadvantages, ever-increasing efforts have been made for several years to improve the supply of concentrated brine to the anode.

U.S. Pat. No. 3,795,603 discloses a structure wherein through the hollow stem of the anode, and a series of ducts, brine is pumped and fed through a multiplicity of holes, all the way to the interelectrodic gap.

Unfortunately, according to this method, the anode structures as well as the brine feed system are excessively complicated. Moreover, a bubble effect is observed at the anode surface due to an inefficient disengagement of anodic gas bubbles therefrom, with a consequent increase in the cell voltage.

U.S. Pat. No. 3,725,223 contemplates vertical baffles protruding from the edge of some anodes upstream to the brine flow. Such baffles cut off the brine flow along the cell, forming barriers crosswise the cell which force the brine to flow under the lower edge of the baffles and hence into the interelectrodic gap. However, the hydraulic effect is not very appreciable, as the brine forced to pass under the baffles immediately climbs up again close to them through the anode meshes. The said baffles must anyway be limited in number to keep pumping costs tolerable and the brine flowing under the baffles collides violently with the mercury below, with possible breaks of the mercury liquid blanket running down the sloping bottom of the cell countercurrently with the brine.

U.S. Pat. No. 4,035,279 teaches the use of a lid slanting over a graphite anode, thereby intercepting the anodic gas which is relieved along the upper edge of the slanting lid. The gas volume withdraws more electrolyte through a part of the anode perimeter. The effectiveness of such a method is however hardly appreciable as the electrolyte flow withdrawn through part of the anode perimeter is not uniformly distributed and tends to involve only some peripheral areas of the anode surface, with a consequent unbalance of the anode current density thereat. Such a disadvantage causes an initially localized deactivation of the electrocatalytic coating and a rapid exhaustion of the anode due to the arising of a real current density increase on the still active areas of the anode surface. The method is furthermore disadvantageous in that the height of the electrodic structure is added to the elevation of the slanting lid which therefore must not be very high with respect to the horizontal plane, otherwise the lid would partially emerge from the brine head in the cell with a substantial loss of efficiency. The inclination must therefore be in the range of 10°–15°. However, this greatly limits the available hydraulic lift as much of the available kinetic energy is lost in the collision of the substantially up-over flow of the gas-liquid dispersion with the lid at an angle much greater than 45°.

OBJECTS OF THE INVENTION

It is an object of the invention to provide an improved method and hydraulic means therefore to improve mass transfer to the anode surface.

It is another object of the invention to provide an anode structure embodying hydraulic means capable of improving mass-transfer to the anode surface.

It is a further object of the present invention to provide a novel method for the electrolysis of an alkali metal chloride in a mercury-cathode cell and a novel electrolytic cell. These and other objects and advantages of the invention will become obvious from the following detailed description.

THE INVENTION

The novel structure of the invention is comprised of a substantially planar and horizontal open-structure electrode face optionally provided with an electrocatalytic outer surface, a plurality of baffles uniformly distributed about the rear of the electrode face, said baffles alternately slanting one way and the opposite way with respect to a vertical axis, their lower edges defining on the upper surface of the foraminous electrode an alternating series of areas respectively intercepted by two adjacent upward-converging surfaces and two adjacent upward-diverging surfaces of the said baffles and means for uniformly conducting current to the electrode face. The structure overcomes the disadvantages of the prior art structures and may not only be used for new cells, but may be adapted to existing cells.

The process of the invention is characterized in that, on the substantially planar, foraminous anode structure, there are arranged a series of baffles uniformly distributed over the entire anode surface and alternately slanting one way and the opposite with respect to the vertical axis, such alternately slanting baffles with their lower edges define at their base, adjacent to the upper surface of the foraminous and substantially plane anode, an alternate series of areas respectively intercepted by two adjacent upward converging surfaces and by two adjacent upward-diverging surfaces of adjacent baffles. Such baffles intercept the uprising gas bubbles evolved at the anode surface, inducing an upward motion of the electrolyte within the fluid body included between pairs of baffles converging at their tops and a downward motion of the electrolyte included between pairs of baffles diverging at the top. The baffles are uniformly distributed over the entire projected surface of the anode and their elevation may be equal to that of the structure carrying current to the anode or even greater, but lower anyway than the electrolyte head in the cell to avoid hindering the regular flow of electrolyte along the cell. The baffles constitute hydrodynamic means effective in generating a forced convective motion of the electrolyte between the surnatant electrolyte bulk and the electrolyte within the interelectrodic gap, uniformly over the entire active surface of the anode.

The available hydraulic energy represented by the upward lift caused by the gas bubbles evolved at the anode surface is not only exploited at best to generate a reflux motion of the electrolyte but, above all, to avoid a non-uniform reflux thereof on the active surface of the anode.

The baffles are preferably made of flat or slightly curved sheets of a length substantially equal to the anode's width, and are positioned, with their edges parallel, a certain distance from one another, alternately slanting one way and the opposite with respect to the vertical axis. The baffles' lower edges are in contact with, or closely adjacent to, the upper surface of the anode mesh. In a vertical section, drawn normally to the baffles' surfaces, the structure comprised of the anode mesh and the baffles may be represented by a series of inverted trapezoidal figures, the anode mesh sections and the baffles' sections respectively representing the lower bases and the slanting sides thereof, while the baffles' upper ends define by points the upper bases. Obviously, the slanting sides may also assume a curved shape to form Venturi-type cross-sectional contours, or a broken line shape with segments having varying angles of inclination. More preferably, the anode mesh section may advantageously be divided into alternately long and short segments, which are respectively defined by (a) the lower ends of two adjacent, upwards-converging baffles and (b) the lower ends of one of said baffles and the lower end of the next baffle adjacent thereto in the series, these two latter forming in turn a pair of upwards-diverging baffles. The long and short segments in the section correspond to respectively large and small electrodic areas in the plane. The entire anode surface is thus preferably divided into a series of regularly alternate large and small areas. This greatly contributes to increase the induced recirculation motion even with baffles of relatively small effective height.

Considering that, with steady state conditions, the amounts of gas evolved per unit anode surface is constant, the gas evolved at the anode area corresponding to a large area defined in the anode plane by a pair of upwards-converging baffles is intercepted by said baffles' surface and rises through the electrolyte body therebetween while, in the same way, the gas evolving at the anode area corresponding to a small area rises through the electrolyte body included between two upwards-diverging baffles' surfaces.

For simplicity one may consider that the density of the fluid mixture formed by the electrolyte and the gas bubbles is therefore much lower in the fluid body between the converging baffles than it is in the fluid body between the diverging baffles. An upward motion of the electrolyte is thus established within each pair of upward-converging baffles, as well as a downward motion of the electrolyte within each pair of upward-diverging baffles. As a result of these combined effects, multiple recirculation motions are generated from the electrolyte bulk above the anode structure to the bulk of electrolyte contained between the anode surface and the cathode below through the openings of the foraminous electrode sheet.

The recirculation motion practically involves the entire anode surface, thus avoiding the occurrence of concentration gradients of anionic species along the anode surface with consequent unbalances of the anode current density which in turn promote the deactivation of the anodes. The process of the invention is furthermore advantageous in that the reflux rate may be varied to adapt to the operational conditions of a particular plant, such as for instance the current density, the brine recycle rate or depletion rate, the closed to empty areas ratio of the anodic structure or mesh, etc. The rate of recirculation induced by the above-described baffles may be varied within a wide range, the baffles' effective height, that is the distance between the baffles upper edge and the anode surface, being constant, by adjusting the area of the anode surface defined by each pair of diverging baffles, that is by varying the large to small area ratio. This is easily accomplished by suitably bending more or less the baffles with respect to the vertical axis.

It has been experimentally demonstrated that the said ratio should be greater than 1 in order to obtain a strong recirculation even with relatively small effective heights of the baffles and that more preferably it should be equal to or higher than 2 to induce a strong reflux with a baffle's effective height of only about 50 mm. However, the ratio may also be equal or even lower than 1 although in this case it is necessary to make the height of the baffles much higher to accomplish a sufficient recirculation. On the other hand, when such a ratio is raised to values between 7 and 10, the gas bubbles evolved at the small areas of the anode are too energetically dragged downwards, that is towards the cathode, as a result of the high downward speed of the electrolyte through the anode meshes between the lower edges of each pair of upward-diverging baffles. In mercury-cathode cells for sodium chloride brine electrolysis, impingement of the gaseous chlorine and the amalgam should be limited or avoided. In such instances, the large to small areas ratio should therefore be desirably kept between 2 and 5. Within such preferred limits, the said ratio may be advantageously varied depending on the current density and the anode structure characteristics to attain the best results. Data relating to particular anode structures and typical operational parameters are set forth in the examples hereinafter reported in the disclosure.

The baffles may assume a straight, curved or broken profile, preferably they form, for a substantial portion of their effective height, an angle equal to or greater than 45°, and often between 45° and 75°, with the foraminous structure although other profiles may be resorted to. The baffles are conveniently made of any material resistant to the harsh conditions met in an electrolysis cell. Titanium, polyvinylchloride or polyester are suitable for use in the electrolysis of an alkali metal chloride brine.

Whereas, for the sake of simplicity of description and execution, the hydrodynamic means of the invention have been hereinbefore described as undirectional and represented by longitudinal baffles with their edges in a parallel relationship, it is understood, as will be obvious to anyone skilled in the art, that the same process of recirculation may be carried out just as successfully using multidirectional or cellular structures comprising cells in the shape of truncated cores or pyramids in an alternate sequence of normal and upside-down positions.

This type of bidirectional structure may be conveniently represented by the well-known egg-containers wherein the cone vertexes are truncated on both sides. By placing such a structure onto the anode mesh, the same effect is produced as above described in the case of a unidirectional structure. Therefore, whenever the term "baffle" is used, it is to be read as embracing both longitudinal or undirectional structure and any other kind of structure in a shape assimilable, in an elevation cross section thereof any way oriented, to the system described with reference to longitudinal baffles with their edges mutually parallel.

The hydrodynamic means of the invention which according to a preferred embodiment thereof, consists of the described baffles positioned above the foraminous electrode may be advantageously integrated in the electrode structure itself wherein, for example, the baffles made of a valve metal act as current conducting means to the anode mesh, which may be welded directly along the baffles lower edges, whereas the upper edges thereof may be welded to one or more bus bars connected to the current conducting stem.

A mercury-cathode cell utilized for sodium chloride brine electrolysis and equipped with the hydrodynamic means of the present invention is characterized, if compared with a similar cell not embodying said means, by a lower operating voltage and a lower oxygen content in the chlorine produced and it may be safely operated with a much higher depletion rate. In addition to these advantages, a considerable increase in the anode life is observed which, as indicated from rapid aging comparative tests is estimated to be in the order of one and a half times to two times the life of the same anodes without the hydrodinamic means of the invention for the reflux of the electrolyte.

Referring now to the drawings.

Figure 1:
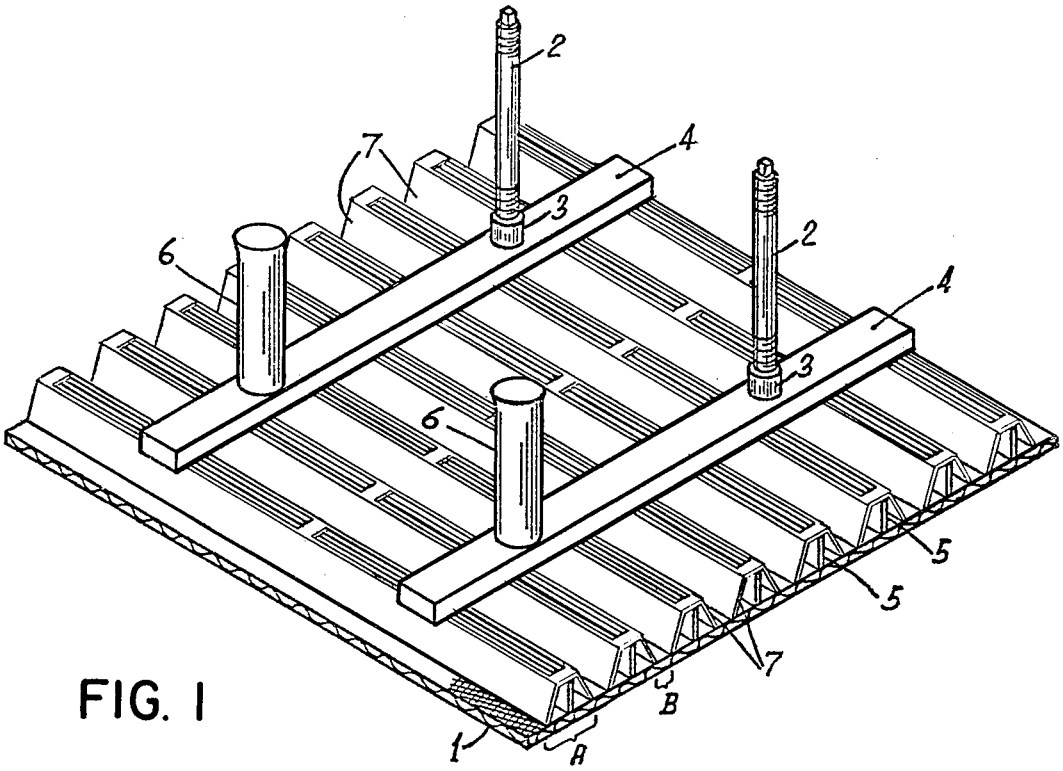
FIG. 1 is a perspective view of an anodic structure commonly used in mercury-cathode cells featuring the hydrodynamic means of the invention.

FIG. 1 illustrates a typical anodic structure for mercury-cathode cells as described in detail in Italian Pat. No. 894,567. The structure is made of titanium and the active surface of the anode is comprised of a planar, foraminous titanium structure 1 coated with a layer of catalytic, conductive oxides of platinum group metals. Current is distributed to the anode by means of four conducting copper stems 2, screwed onto the titanium ferrules 3 welded to the titanium primary distribution bars 4. Eight titanium secondary distribution bars 5 are welded to the two primary bars 4 and the titanium mesh 1 provided with the electrocatalytic coating is welded to the lower edges of the secondary bars 5. Titanium sleeves 6 welded onto the titanium ferrules 3 prevent the copper conducting stems from contacting the electrolyte and the evolved chlorine.

The hydrodynamic means of the invention consists of titanium baffles in the shape of elongated sheets 7, suitably welded or fixed by clips onto each of the secondary distribution bars 5. The lower edges of baffles 7, slanting alternatively in one direction and the opposite with respect to a vertical axis, define an alternate sequence of large areas A and small areas B on the surface of the anode mesh 1, whereas the liquid body submerging the anode structure is similarly divided by baffles 7 into a series of volumes each defined by the surfaces of two adjacent baffles.

Figure 2:
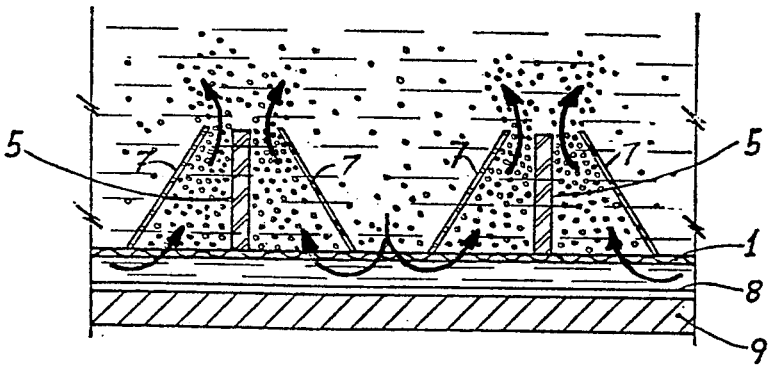
FIG. 2 is a magnified detail of an elevation cross section of the structure of FIG. 1.

FIG. 2 is a magnified detail of an elevation cross-section of the structure of FIG. 1. For the sake of illustration, FIG. 2 wherein the parts corresponding to FIG. 1 are labelled with the same numbers, also comprises the mercury cathode 8 running on the cell bottom 9.

As depicted in FIG. 2, the chlorine gas bubbles evolved at the large areas A of anode 1 of FIG. 1 are intercepted by the upwards-converging surfaces of two adjacent baffles 7. The density of the bubbles in the electrolyte tends to grow higher and higher up to the upper edges of the baffles due to the narrowing of the section normal to the bubbles' upward motion. Conversely, the chlorine gas bubbles evolved at the small areas of anode 1 of FIG. 1 rise through the electrolyte bulk included between the upwards-diverging surfaces of two adjacent baffles 7.

The fluid bodies comprising the electrolyte and the chlorine gas bubbles dispersed therein and respectively included between two upwards-converging surfaces and two upwards-diverging surfaces, may be thought therefore as having different density values, whereby an upward motion is established within the fluid body included between the converging surfaces as well as a downward motion within the fluid body included between the diverging surfaces. Such a motion, schematically shown by the arrows in FIG. 2, is effective for transferring concentrated brine from above the interelectrodic gap and for reducing the establishment of a high concentration gradient between the brine within the interelectrodic gap and the brine above the anodic structure due to chlorine anions depletion as a result of electrolysis. The reflux motion of the brine causes the same to sweep vigorously through the anode mesh, whereby the convective mass (i.e. chlorides) transfer to the anode surface is greatly improved. Such effect is practically uniform over the entire anode surface, and concentration gradients are effectively prevented from occuring along the anode surface plane.

The baffles effective height is generally between 30 and 100 mm and they may be fixed either to the bars 5 or to the anode structure 1, as well as to both. When required or possible, they are however more desirably fixed only along their upper or lower edges, so that their effect may be varied at will by adjusting their inclination or by varying the large A area to small B area ratio of FIG. 1, according to the requirements of a particular electrolysis cell. The baffles' effective height may be also increased by vertically extending the upper edges thereof.

Though the baffles have been illustrated substantially flat, they may also conveniently assume a curved shape, that is the angle of inclination may vary continuously along the height of the baffle to form Venturi-type variable cross-section passage for the uprising fluid between the upward-converging baffle surfaces or the angle of inclination may vary step-wise to produce a baffle's profile in the form of a broken line. More preferably though, the angle of inclination of the baffles with respect to the plane foraminous electrode structure assumes a value equal or greater than 45° at least for a substantial portion of the effective height of the baffles.

Figure 3:
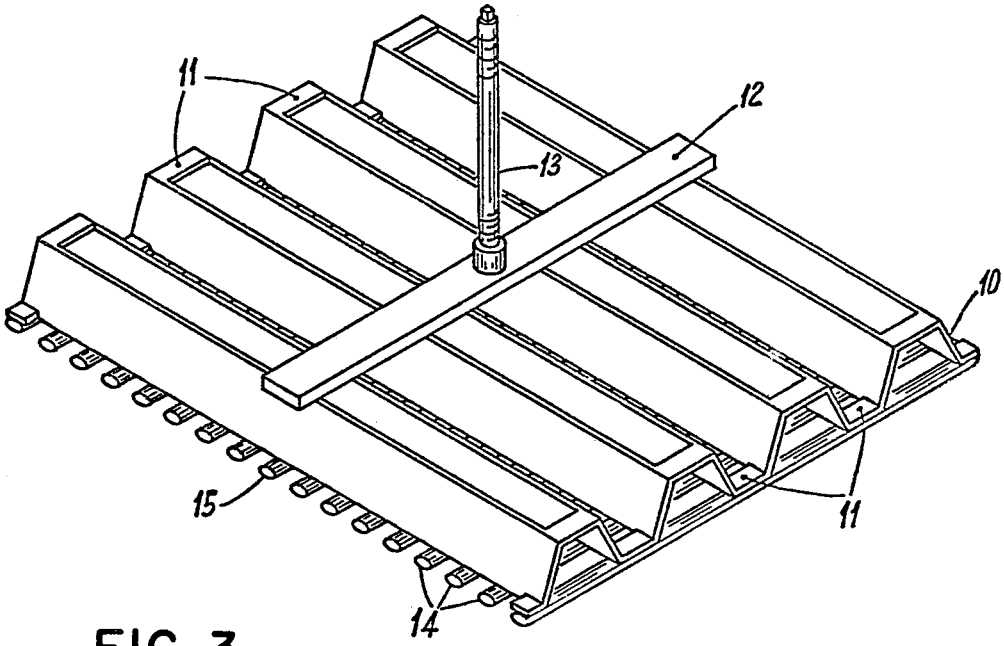
FIG. 3 is a perspective view of an anode integrally embodying the hydrodynamic means of the invention with a rod anode surface.

FIG. 3 illustrates another preferred embodiment of the hydrodynamic means of the invention, wherein the hydrodynamic means are integrated in the anodic current distribution structure and effectually replace the secondary bars 5 of FIGS. 1 and 2. A titanium or other valve metal sheet 10 is bent to produce trapezoidal waves. The upper and lower bases of the trapezoidal waves are open along their almost entire length, with the exception of small stretches 11 at the lateral ends ard one or more points along the waves. This may be accomplished after bending the sheet or before bending the same, in this latter case providing suitable slits in the sheet prior to bending.

One or more primary distribution bars 12 made of titanium, are welded normally to the trapezoidal waves and are connected to one or more conducting stems 13. Normally to the bases of the trapezoidal waves of sheet 10 are then welded a series of titanium rods 14 coated with a layer of electrocatalytic material to form the anode 15. A titanium or other valve metal expanded sheet, similarly provided with an electrocatalytic coating, may take the place of the series of rods 14. The slanting sides of the trapezoidal waves of sheet 10 carry out the same function as the baffles 7 of FIGS. 1 and 2 as well as that of the secondary bars 5 illustrated in FIGS. 1 and 2.

With the structure of FIG. 3, the possibility of adjusting the inclination of the baffles after the assembling of the anode structure is no longer available. Therefore, the shape of the trapezoidal waves must be preventively tailored to suit the conditions of a particular cell. Moreover, in this instance, the hydrodynamic means cannot be made of a plastic material. The structure of FIG. 3 entails the additional advantage of increasing the number of welded points between sheet 10 and the foraminous structure of the anode 15, for the same weight of the titanium and for the same current carrying metal cross section. This reduces the ohmic drop through the foraminous structure 15.

Figure 4:
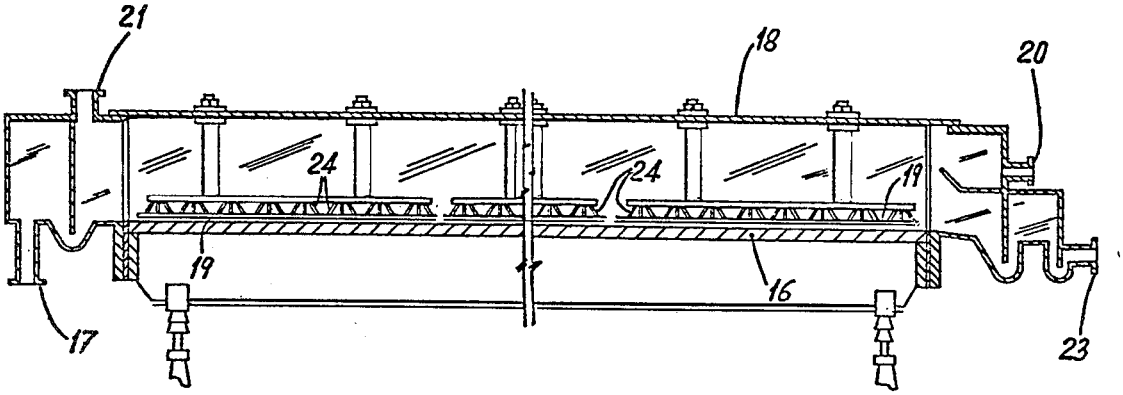
FIG. 4 is a longitudinal cross-section of a mercury-cathode electrolysis cell equipped with the hydrodynamic means of the invention.

FIG. 4 is a longitudinal cross-section of a modern mercury-cathode cell for the electrolysis of sodium chloride, equipped with the hydrodynamic means of the invention for the brine recirculation within the interelectrodic gap. The cell is essentially comprised of a flat steel bottom 16, slightly inclined lengthwise and connected to the negative pole of an electric source. The mercury is fed through inlet 17 and flows forming a continuous and uniform liquid layer on the cell bottom. A rubber sheet 18, sealably fixed to the cell walls acts as a cover for the electrolysis cell 1 and series of anodes 19, hanging from trestles over sheet 18, not shown in the figure, are positioned parallel to the flowing mercury cathode at a distance of some millimeters therefrom. The anodes are suitably connected to the positive pole of the electric source. The saturated brine is fed to the cell through inlet 20 and the depleted brine, together with the evolved chlorine, is withdrawn from outlet 21.

During operation of the cell, chloride ions are discharged at the anodes 19 surfaces to yield molecular chlorine, while sodium ions are reduced at the mercury cathode to form a sodium-mercury amalgam which is continuously discharged through outlet 23. The amalgam is then passed through a decomposer wherein the mercury is restored to its metal state with formation of sodium hydroxide and evolution of hydrogen.

The hydrodynamic means for the brine recirculation in the interelectrodic gap are labeled as 24 in FIG. 4. The baffles 24 orientation is indicated as normal to the cell length, but they may also be parallel to the cell length, as such orientation has no appreciable effect on the baffles function, especially when the brine head over the baffles is much higher than their height.

In the following example there are described several preferred embodiments to illustrate the invention. However, it is to be understood that the invention is not intended to be limited to the specific embodiments.

EXAMPLE

A mercury cathode electrolysis cell with an area of 15 square meters was equipped with 28 dimensionally stable anodes with the construction of FIG. 1. The anodes were made of titanium and the anode face was coated with a mixed crystal material of ruthenium oxide and titanium oxide as described in U.S. Pat. No. 3,778,307. The anode face had a surface area of 690 mm×790 mm and the anodes were equipped with 16 baffles made of titanium sheet with a thickness of 0.5 mm and a height of 40 mm. The ratio of large area A to small area B of FIG. 1 was 3.2 and the angle between the baffles and the anode face was 58°.

The cell was used to electrolyze in an extended run a brine containing 300 g/l of sodium chloride and having a pH of 4. The temperature of the feed brine was 70° C. and the current density, as referred to the anode area, was 11 KA/m$^2$. For comparison purpose, a similar cell in the same plant equipped with the same anodes but without the baffles was operated under the same conditions and the results are reported in Table I.

TABLE I

| | Cell w/o baffles | Cell with baffles |
|---|---|---|
| Cell voltage | 4.20 V | 3.97 V |
| brine temperature at the outlet | 83° C. | 81° C. |
| brine pH at outlet | 2.8–3.2 | 2.5–2.7 |
| % by volume of oxygen in chlorine | 0.3–0.5 | n.d. to 0.2 |
| % by volume of hydrogen in chlorine | 0.1 to 0.4 | n.d. to 0.2 |

n.d. - not detectable.

The results of Table I clearly show the unexpected advantages of the cell of the invention equipped with baffles as it resulted in a remarkable reduction in the cell voltage as well as a reduction in the oxygen and hydrogen levels in the chlorine product which improved efficiency. Moreover, the lower pH of the outlet brine has the additional advantage that less acid is required to be added to the brine in the dechlorination stage prior to resaturation thereof.

Various modifications of the process and apparatus of the invention may be made without departing from the spirit or scope thereof and it should be understood that the invention is intended to be limited only as defined in the appended claims.

We claim:

1. A method of generating, in an electrolysis cell wherein gas evolution takes place at one electrode, multiple recirculation motions of the electrolyte to and from the interelectrodic gap defined by a substantially horizontal planar cooperating electrode and by a substantially planar foraminous, gas evolving electrode, parallel to and suspended a distance over the cooperating electrode surface, and immersed in a pool of electrolyte, comprising providing over the substantially planar foraminous gas evolving electrode a multiplicity of baffles uniformly distributed over the entire surface of the foraminous electrode, alternately slanting the baffles one way and the opposite with respect to the vertical axis, the lower edges of said baffles, adjacent to the upper surface of the substantially planar foraminous electrode, dividing the electrode surface into an alternate series of areas intercepting between all pairs of upward converging surfaces of oppositely slanted adjacent baffles the gas bubbles evolved over the relative areas intercepted on the foraminous electrode and flowing upward through the said converging surfaces the electrolyte contained therein by the gas-lift effect of the gas bubbles dispersed therein and flowing downward, between all pairs of upward diverging surfaces of oppositely slanted adjacent baffles the electrolyte contained therein through the relative areas, on the foraminous electrode, adjacent to said first areas by induction of the upward, gas-lift generated, motion of the electrolyte between the adjacent upward converging surfaces.

2. The method of claim 1 wherein the ratio between two adjacent areas of the foraminous electrode respectively intercepted on the rear of the electrode surface by a pair of upward converging baffles and a pair of upward diverging baffles, is greater than unity.

3. The method of claim 1 wherein at least for a substantial portion of the effective height of the baffles, the angle between the surface of the electrode and the baffle surfaces is comprised between 45° and 75°.

4. A hydrodynamic means for improving the convective mass transfer to a substantially planar, foraminous electrode whereat gas evolution occurs and suspended a certain distance over a substantially plane horizontal cooperating electrode, said hydrodynamic means comprising a series of baffles uniformly distributed over the entire foraminous electrode surface and alternately slanting one way and the opposite with respect to a vertical axis, the lower edges thereof defining on the upper surface of the foraminous electrode alternate series of areas wherein any two adjacent areas are respectively intercepted one by two upward-converging surfaces and the other by two upward-diverging surfaces of said baffles.

5. The baffles means of claim 4 wherein the ratio between two adjacent areas of the foraminous electrode respectively intercepted by two upward-converging surfaces and by two upward-diverging surfaces of said baffles is greater than unity.

6. A planar foraminous electrode structure for use in horizontal electrolysis cells in a parallel relationship with a plane horizontal cooperating electrode below and suspended a certain distance therefrom having hydrodynamic means for generating multiple recirculation motion of the electrolyte between the bulk of the electrolyte body above said electrode structure and the electrolyte contained within the interelectrodic gap, said electrode structure comprising a substantially horizontal foraminous plate suspended over the cooperating electrode and connected to a current distributing structure comprising a series of members having surfaces alternately slanting one way and the other with respect to a vertical axis, the slanting surfaces thereof defining, on the foraminous plate connected to the lower edges of said members alternate series of areas wherein any two adjacent areas are respectively intercepted by upward converging and upward diverging surfaces of said members and means connected to the upper edges of said slanting members for carrying current to said electrode.

7. The electrode structure of claim 6, wherein the ratio between two adjacent areas of the foraminous plate respectively intercepted by two-upward-converging surfaces and by two upward-diverging surface of said baffles is greater than unity.

8. The electrode structure of claim 6 wherein both the current distributor and the foraminous plate are made of valve metal and wherein the foraminous plate is at least partially coated with a non-passivatable electrocatalytic coating.

9. The electrode structure of claim 7 wherein the large to small area ratio, said areas being respectively intercepted on the surface of the substantially horizontal foraminous plate by the upward converging and the upward diverging surfaces of said slanting members is between 2 and 10 and wherein the angle between the slanting surfaces and the foraminous plate is comprised between 45° and 75° at least for a substantial portion of the effective height of said slanting members.

10. In a mercury cathode electrolysis cell for the electrolysis of alkali metal chloride brine comprising one or more substantially plane foraminous anodes suspended a certain distance over the mercury cathode, the improvement comprising arranging on said substantially plane foraminous anodes the hydrodynamic means of claim 4.

11. In an electrolytic process for generating chlorine by the electrolysis of an alkali metal chloride brine in a mercury cathode electrolysis cell, the improvement comprising generating multiple recirculation motions of the electrolyte to and from the interelectrodic gap through the opening of foraminous anode by the method of claim 1.

* * * * *